US010745955B2

(12) United States Patent
Svara et al.

(10) Patent No.: US 10,745,955 B2
(45) Date of Patent: Aug. 18, 2020

(54) MOVEMENT CONTROL DEVICES

(71) Applicant: Titus d.o.o. Dekani, Dekani (SI)

(72) Inventors: Valter Svara, Izola (SI); Danijel Kozlovic, Dekani (SI)

(73) Assignee: Titus d.o.o. Dekani, Dekani (SI)

( * ) Notice: Subject to any disclaimer, the term of this patent is extended or adjusted under 35 U.S.C. 154(b) by 0 days.

(21) Appl. No.: 16/312,685

(22) PCT Filed: Jun. 23, 2017

(86) PCT No.: PCT/EP2017/065579
§ 371 (c)(1),
(2) Date: Dec. 21, 2018

(87) PCT Pub. No.: WO2017/220797
PCT Pub. Date: Dec. 28, 2017

(65) Prior Publication Data

US 2019/0330904 A1 Oct. 31, 2019

(30) Foreign Application Priority Data

Jun. 24, 2016 (GB) ..... 1611059.5

(51) Int. Cl.
*E05F 1/08* (2006.01)
*E05F 3/22* (2006.01)
*E05F 1/16* (2006.01)

(52) U.S. Cl.
CPC ..... *E05F 3/22* (2013.01); *E05F 1/16* (2013.01); *E05Y 2900/132* (2013.01)

(58) Field of Classification Search
CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05F 3/224; E05Y 2800/24; E05Y 2201/64; E05Y 2201/644; E05Y 2201/264; E05Y 2201/41; E05Y 2201/47; E05Y 2201/21; E05Y 2201/488; E05Y 2900/132; E05Y 2900/142; E05Y 2900/14; Y10T 16/27; Y10T 16/56; Y10T 16/61; Y10T 16/593; Y10T 16/276; Y10T 16/281
See application file for complete search history.

(56) References Cited

U.S. PATENT DOCUMENTS 9,945,167 B2 4/2018 Svara et al.
2004/0237252 A1* 12/2004 Hoshide ..... E05F 1/16 16/72

(Continued)

FOREIGN PATENT DOCUMENTS

DE 102007059575 A1 6/2009
EP 2957697 A1 12/2015

(Continued)

*Primary Examiner* — Chuck Y Mah
(74) *Attorney, Agent, or Firm* — Alan D. Kamrath; Karin L. Williams; Mayer & Williams PC

(57) ABSTRACT

A device is provided for controlling the motion of a movable member such as a sliding door. The device comprises two springs. Each spring has its own catch for releasably holding it in a pre-loaded condition. The catches are releasable by motion of the door to apply force to its closing movement. The catches are arranged so that one of the springs will exert force on the door before the other.

10 Claims, 3 Drawing Sheets

(56) References Cited

U.S. PATENT DOCUMENTS

| | | | | |
|---|---|---|---|---|
| 2006/0016279 | A1* | 1/2006 | Sato | E05F 1/16 74/89.17 |
| 2010/0026152 | A1* | 2/2010 | Huang | A47B 88/467 312/319.1 |
| 2010/0031468 | A1* | 2/2010 | Tomiji | E05F 5/027 16/52 |
| 2011/0023370 | A1* | 2/2011 | Zimmer | E05F 1/16 49/360 |
| 2011/0080080 | A1* | 4/2011 | Zimmer | A47B 88/467 312/319.1 |
| 2011/0167588 | A1* | 7/2011 | Chang | E05F 5/003 16/71 |
| 2013/0182978 | A1* | 7/2013 | Huang | E05F 5/003 384/21 |
| 2014/0026357 | A1* | 1/2014 | Zimmer | E05F 1/16 16/72 |
| 2014/0109343 | A1* | 4/2014 | Chang | E05F 5/003 16/49 |
| 2016/0333622 | A1* | 11/2016 | Glogowski | E05F 5/003 |
| 2017/0130501 | A1* | 5/2017 | Svara | E05F 5/003 |

FOREIGN PATENT DOCUMENTS

| | | | | |
|---|---|---|---|---|
| JP | 2008163704 | A | * | 7/2008 |
| JP | 2008223456 | A | * | 9/2008 |
| JP | 2012112101 | A | | 6/2012 |
| JP | 2015068065 | A | | 4/2015 |
| WO | WO2010143352 | A1 | | 12/2010 |
| WO | WO2011095247 | A1 | | 8/2011 |
| WO | WO2013039269 | A1 | | 3/2013 |

* cited by examiner

MOVEMENT CONTROL DEVICES

BACKGROUND OF THE INVENTION

This invention relates to movement control devices and in particular, though not exclusively, to damped movement control devices for use with sliding doors.

SUMMARY OF THE INVENTION

The invention provides a device for controlling movement of a first member relative to a second member, wherein the device comprises at least two spring biasing elements, means connecting the spring biasing elements between the first and second members for selectively applying a spring biasing force to assist relative movement between the members in a first direction, the connecting means including a catch mechanism for each spring biasing element, with each catch mechanism acting to releasably hold its respective spring biasing element in a pre-loaded condition caused by relative movement between the members in a direction opposite to said first direction, the catch mechanisms being actuable upon relative movement between the members in the first direction, with each catch mechanism being actuable to release its respective spring biasing element at a different stage of said relative movement between the members in the first direction.

BRIEF DESCRIPTION OF THE DRAWINGS

By way of example, embodiments of the invention will now be described with reference to the accompanying drawings, in which.

DETAILED DESCRIPTION OF THE INVENTION

Figure 1:
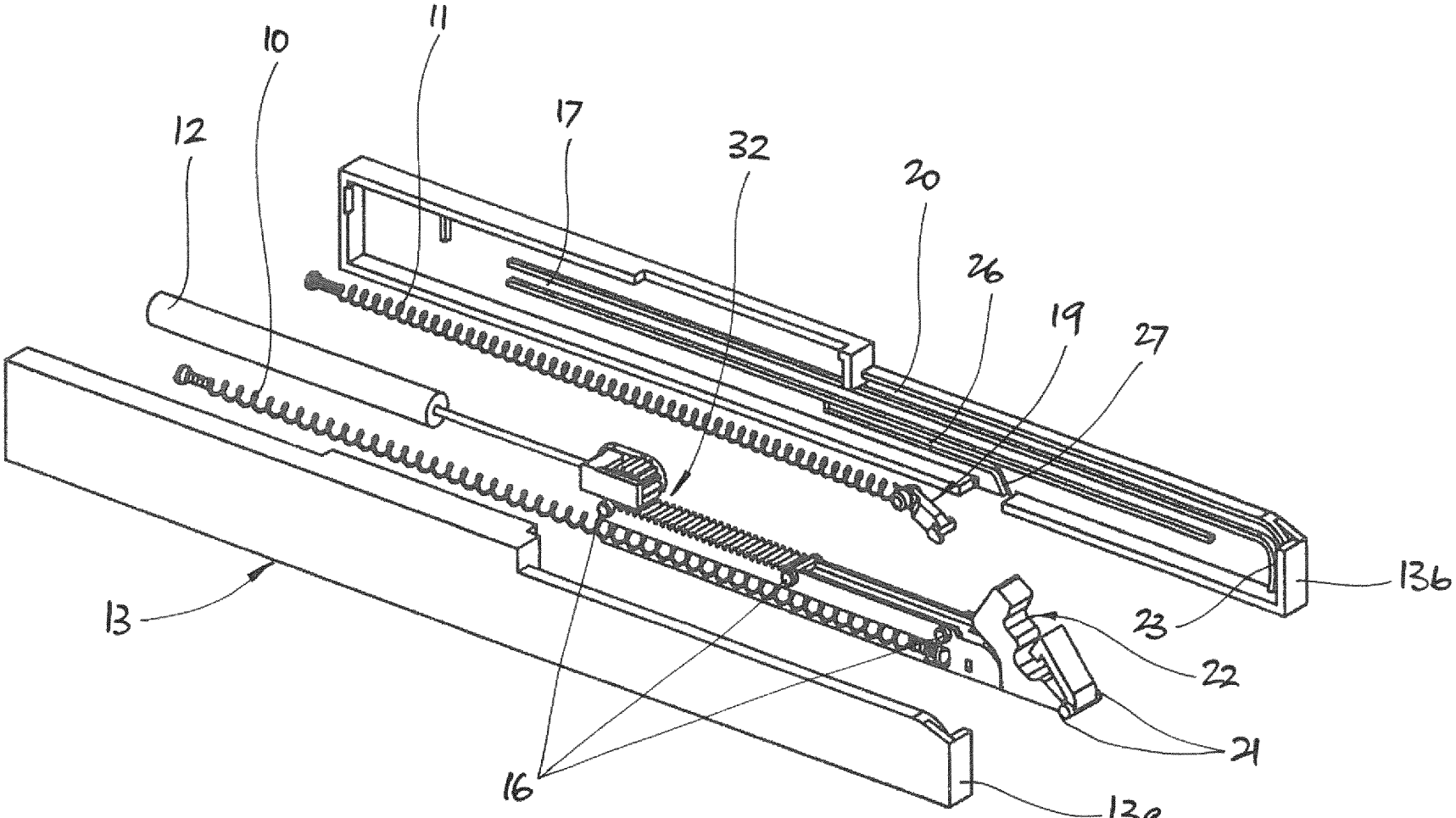
FIG. 1 is an exploded view of a first form of movement control device according to the invention.

The movement control device seen in FIG. 1 is designed to impart a damped spring biasing force to assist the closing movement of a sliding door. The spring biasing force is supplied by two elongate tension springs 10, 11 and the damping is provided by a linear piston and cylinder type damper 12.

Figure 2A:
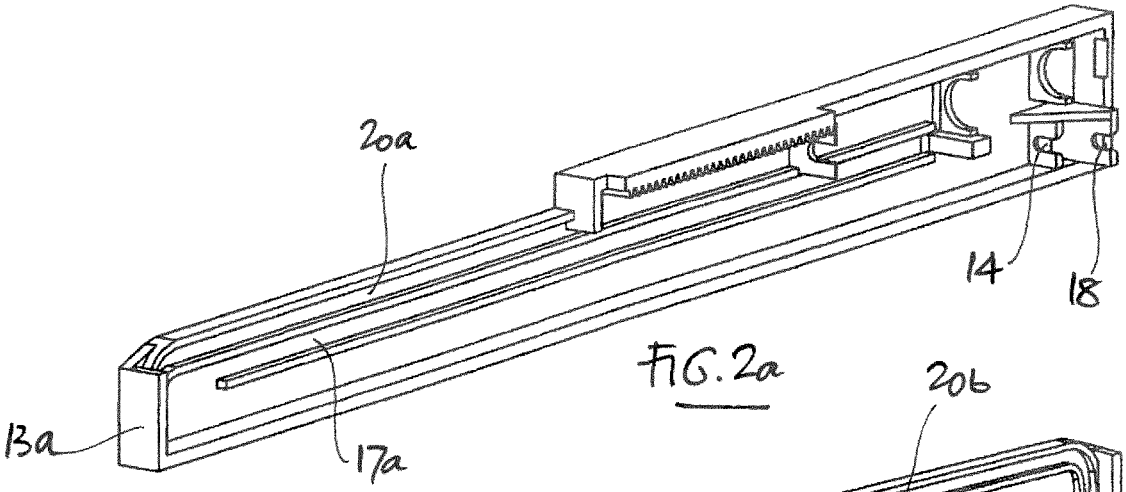
FIGS. 2*a* and 2*b* show the housing halves for the device of FIG. 1.
Figure 2B:
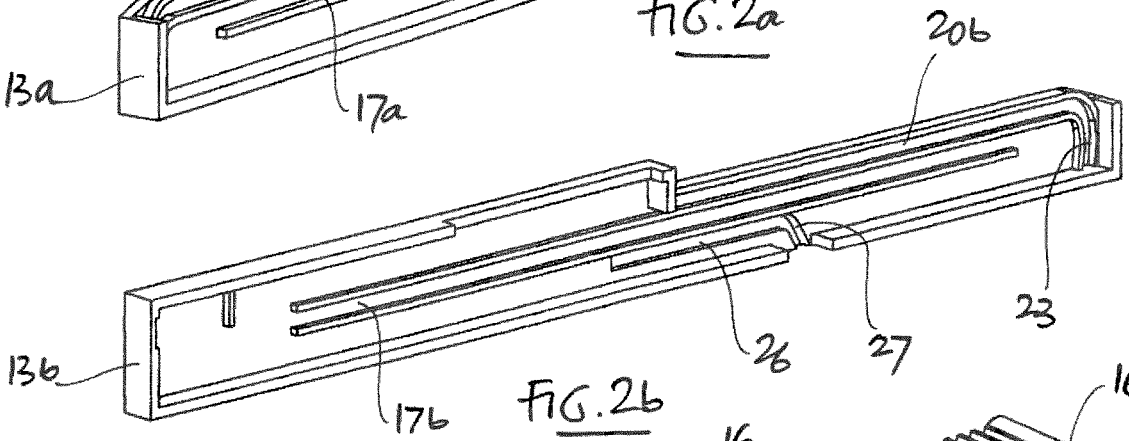

The two springs 10, 11 and the damper 12 are mounted within an elongate housing 13 which is made in two mating halves 13*a*, 13*b* (seen in more detail in FIGS. 2*a* and 2*b*). The housing 13 is designed to be mounted on a door frame, conveniently above the sliding door, with its longitudinal axis aligned generally parallel to the direction of movement of the door. The device is designed to act on the door over part of its range of travel, in particular, over the final stage of its closing movement.

The tension springs 10, 11 are arranged to act in parallel, ie to provide a combined spring biasing force. However, whilst a first one of the springs 10 is arranged to produce a spring biasing force over the whole of the working stroke of the device, the second spring 11 is arranged to produce a spring biasing force over only part of its working stoke. The device incorporates separate latching mechanisms for controlling this staggered operation of the springs 10, 11.

Figure 3:
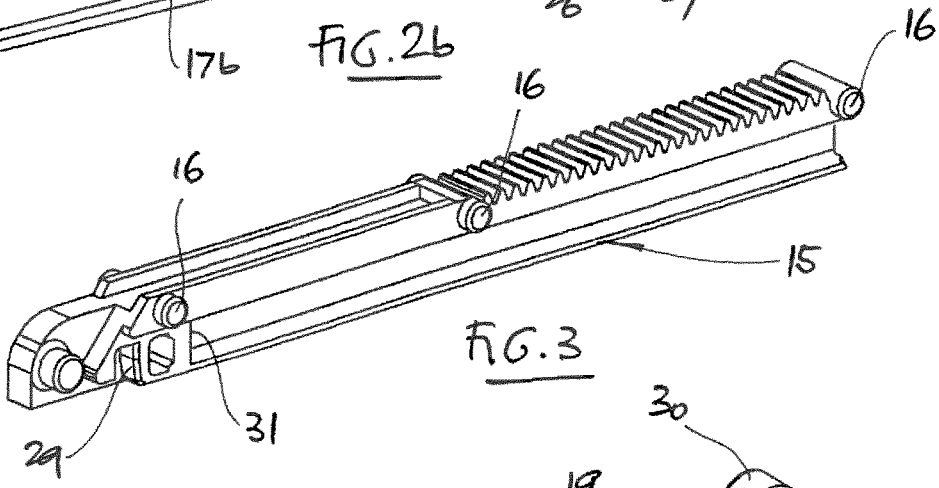
FIG. 3 shows the slider for the device of FIG. 1, FIGS. 4 and 5 show the two spring catches for the device of FIG. 1, and FIGS. 6*a*, 6*b* and 6*c* are schematic illustrations showing operation of the device of FIG. 1.

The first spring 10 is anchored at one end to the housing 13, via a suitable clip 14 on one of the housing halves 13*a* (see FIG. 2*a*). At its other end, the first spring 10 is attached to a slider 15 (seen in more detail in FIG. 3). The slider 15 is constrained to move parallel to the longitudinal axis of the housing 13 through being guided by a series of laterally protruding pins 16 engaging in a first linear track 17 (constituted by part-tracks 17*a*, 17*b* in each housing half 13*a*, 13*b*).

Figure 5:
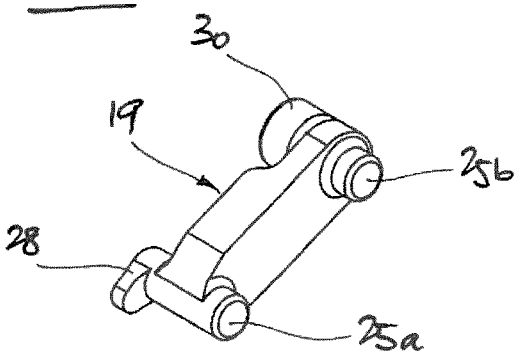

The second spring 11 is anchored at one end of the housing 13, via a suitable clip 18 next to clip 14 on the housing half 13*a*. The other end of the second spring 11 is attached to a catch 19. Catch 19 forms part of the latching mechanism for the second spring 11 (seen in more detail in FIG. 5).

Figure 4:
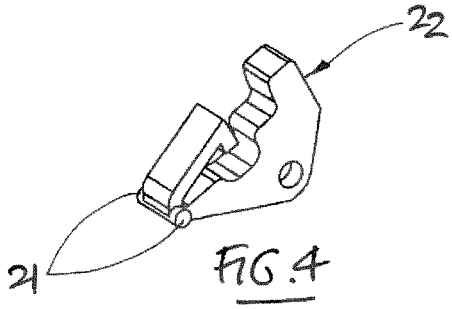

The latching mechanism for the first spring 10 includes a catch 22 (seen in more detail in FIG. 4). Catch 22 is pivotally mounted on one end of the slider 15 and toggles between two end positions. It has a pair of laterally protruding pins 21 which engage a second track 20 (constituted by part-tracks 20*a*, 20*b* on each housing half 13*a*, 13*b*). The track 20 extends for the most part linearly, but ends in a detent 23. The detent 23 extends at an angle to the track 20 and thus acts as a stop face for the pins 21.

In known manner, catch 22 is designed to pivot when it reaches this end of the track 20, with its pins 21 engaging the detent 23 and thus holding the slider 15 in this position. With the slider 15 held in this position, the holding position of catch 22, the first spring 10 is fully extended and hence pre-loaded to its fullest extent. The slider 15 is released from this position when catch 22 toggles to its release position by pivoting so that its pins 21 disengage from the detent 23. This is achieved in known manner by engagement of a stop 24 mounted on the door. Release of the slider 15 allows it to travel back in the housing 13 under the action of the biasing force of the first spring 10. With the stop 24 engaging catch 22, this means that the biasing force of the first spring 10 is also imparted to the door, thus assisting its closing movement.

Catch 19 for the second spring 11 is designed to act in a similar manner and also toggles between two end positions. It has a pair of laterally protruding spaced apart pins 25*a*, 25*b* which engage a third track 26 on the housing 13. The track 26 extends for the most part linearly, but also ends in a detent 27. Catch 19 has a lug 28 (opposite pin 25*a*) which is engageable in a slot 29 in the slider 15, so that when the slider moves, catch 19 moves with it. The lug 28 will move out of engagement with the slot 29 when catch 19 pivots, which it will do when one of its pins 25*a* engages the detent 27 in the track 26.

In this case, the detent 27 does not in itself provide a stop face, because it lies at an acute angle to the track 26. Rather, pin 25*a* is captured in the detent 27 by the slider 15 riding over it. The net effect is that catch 19 will be held in this position, its holding position, with the second spring 11 extended, ie pre-loaded.

Catch 19 further includes a second lug 30 (opposite to pin 25*b*). The second lug 30 is designed to engage a stop face 31 on the slider 15, as will be described in more detail below.

Figure 6A:
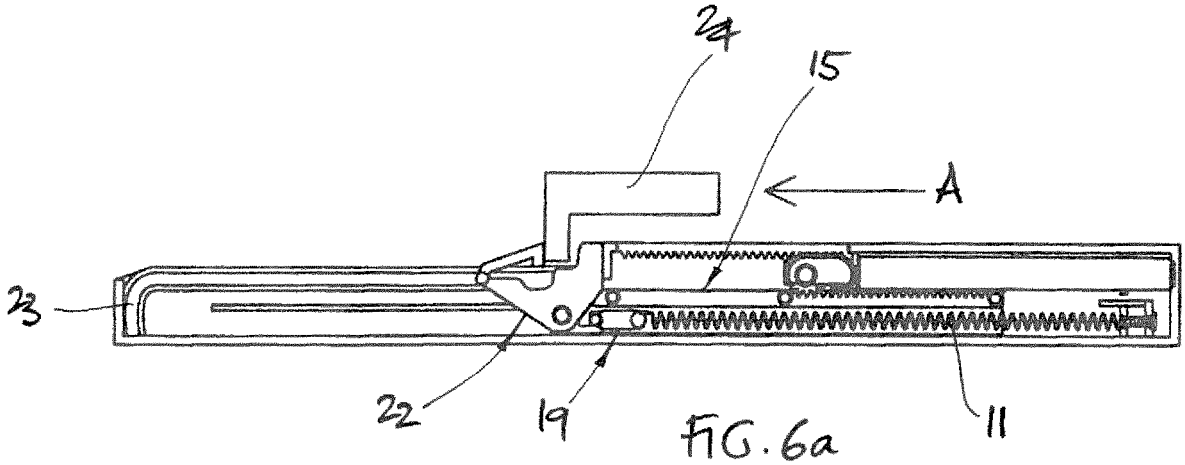
Figure 6B:
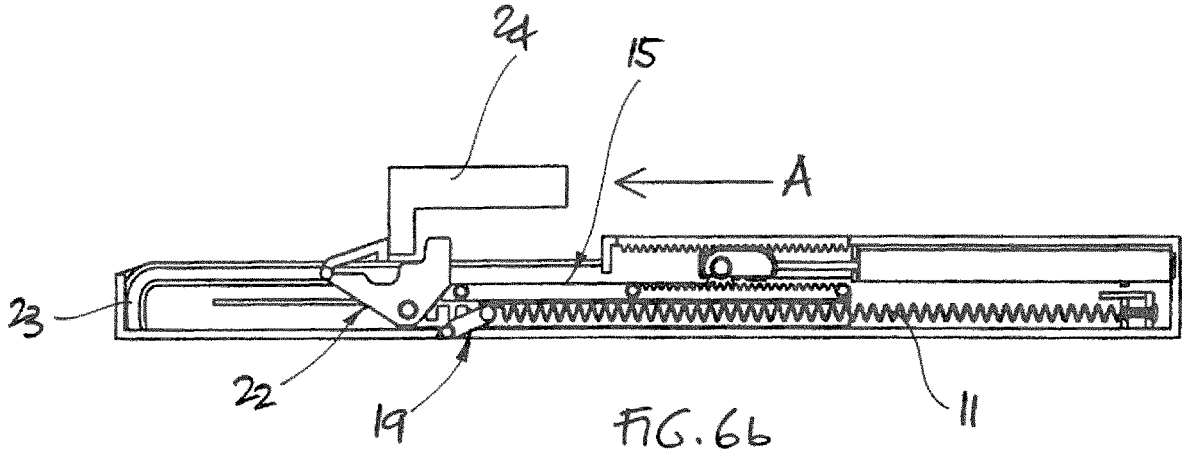
Figure 6C:
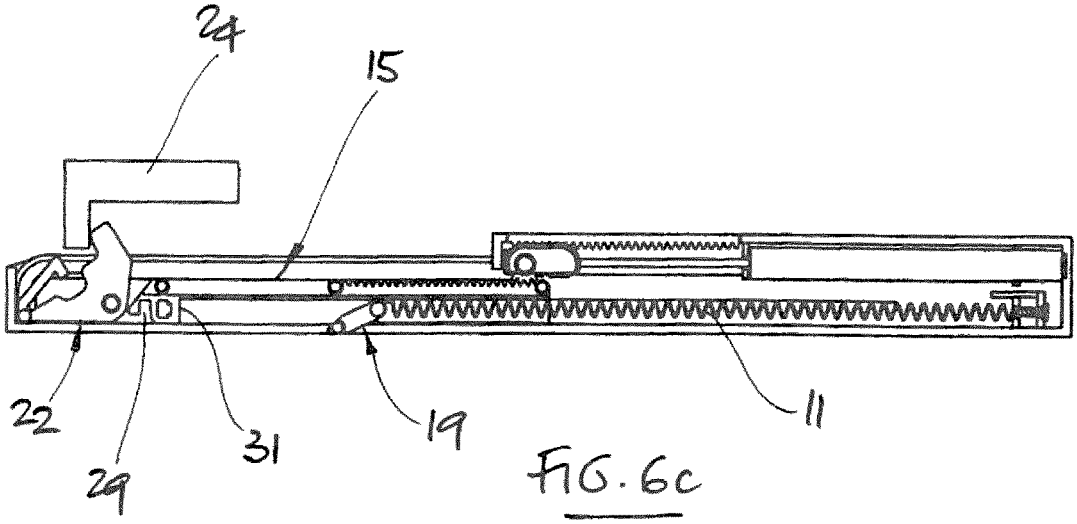

Operation of the device is seen in FIGS. 6*a*, 6*b* and 6*c*. In FIG. 6*a*, the door (not shown) is in it closed position, with the stop 24 on it in engagement with catch 22 on the slider 15 and the lug 28 of catch 19 in engagement with the slot 29 of the slider. Opening movement of the door causes the slider 15 to move in the direction of arrow A, causing extension, ie pre-loading of both springs 10, 11 (only the second spring 11 is seen in FIG. 6*a*). When catch 19 reaches its detent 27, it is caused to pivot, with pin 25*a* moving out of engagement with the track 26 and into engagement with the detent 27. This pivotal movement of catch 19 moves the first lug 28 out of its engagement with the slot 29, thereby releasing catch 19 from the slider 15. Catch 19 is held in this position with respect to the housing 13, with the second spring 11 thus extended, ie pre-loaded. This is the position seen in FIG. 6*b*, with catch 19 in its holding position.

The slider 15 continues to move in the direction of arrow A as the door opens further, further extending the first spring 10 as it does so. This movement continues until catch 22 reaches its detent 23, at which point it is caused to pivot, as described above, and thus disengage from the stop 24 on the door. This pivotal movement of catch 22 sets its pins 21 in engagement with the detent 23, the holding position of catch 22, thereby holding the slider 15 in a fixed position relative to the housing 13. This is the position seen in FIG. 6*c* and at this point the first spring 10 is fully extended, ie pre-loaded to its fullest extent. The door, now disengaged from the device, is able to continue on in its opening movement.

Closing movement of the door is in the opposite direction to arrow A, and the first stage is for the stop 24 to engage catch 22. This engagement causes catch 22 to pivot and toggle to its release position, taking its pin 21 out of engagement with the detent 23 and releasing the slider 15 for movement. The slider 15 is thus free to be pulled by the biasing force of the first spring 10, and the door is pulled with it, since the stop 24 is now back in engagement with catch 22.

This movement continues until the stop face 31 on slider 15 engages the second lug 30 on catch 19, causing it to move with the slider 15. This in turn causes pin 25*a* to move out of the detent 27, imparting a pivotal movement to catch 19 and thus causing the first lug 28 to re-engage with the slot 29 on the slider 15. When this occurs, the slider 15 and hence also the door will be subjected to the biasing force of both springs 10, 11. The final closing movement of the door is thus assisted by the combined biasing force of both springs 10, 11.

In this example, the first spring 10 is arranged to be pre-loaded, ie extended, over essentially the whole of the working stroke of the device, whereas the second spring 11 is pre-loaded, ie extended, over about two thirds of the working stroke. Also, in this example, the two springs 10, 11 have the same spring rate. It will be understood, however, that these parameters can of course be varied to produce different characteristics.

The damper 12 is arranged with its working stroke providing a damped resistance on compression. The damper 12 thus provides damping for the biasing force of the two springs 10, 11 when they operate to assist the closing movement of the door. Operation of the damper 12 is enabled via a toothed rack and pinion mechanism 32, which enables its working stroke to be geared relative to movement of the slider 15.

It will be understood that the idea of providing a device which produces a staggered spring closing force can be manifested in many different ways. For example, the springs need not necessarily be tension springs, they can be of the same or different spring rates and more than two of them may be involved. It is advantageous if the springs combine to produce a compound spring force at the end of the closing movement of the door, as is the case here, because this will help to ensure that the door will close completely. However, the interaction between the multiple spring forces could be tailored to suit other situations.

One of the benefits of a staggered arrangement using multiple springs is that it will help to reduce the effort needed to open the door, compared with conventional solutions, eg for dealing with heavier doors, which typically involve simply doubling up the spring or replacing it with a stiffer one.

The invention claimed is:

1. A device for controlling movement of a first member relative to a second member, wherein the device comprises at least two spring biasing elements connected between the first and second members for selectively applying a spring biasing force to assist relative movement between the members in a first direction, wherein each spring biasing element comprises a catch mechanism, with each catch mechanism acting to releasably hold its respective spring biasing element in a pre-loaded condition caused by relative movement between the first and second members in a direction opposite to said first direction, the catch mechanisms being actuable upon relative movement between the first and second members in the first direction, with each catch mechanism being actuable to release its respective spring biasing element at a different stage of said relative movement between the first and second members in the first direction, and wherein the at least two spring biasing elements each comprise an elongate tension spring that is arranged to act in parallel, such that a first one of the at least two spring biasing elements is arranged to produce a spring biasing force over a whole of the working stroke of the device, and a second one of the at least two biasing elements is arranged to produce a spring biasing force over only a part of the working stroke of the device.

2. A device as claimed in claim 1 wherein the two spring biasing elements are arranged to provide a combined spring biasing force over part of said relative movement between the members in the first direction.

3. A device as claimed in claim 1 wherein the two spring biasing elements have different spring rates.

4. A device as claimed in claim 1 wherein each catch mechanism is movable between a holding position in which its respective spring biasing element is held in a pre-loaded condition, and a release position in which its respective spring biasing element is free to return towards its unloaded condition.

5. A device as claimed in claim 4 wherein each catch mechanism toggles between its holding and release positions by pivotal movement.

6. A device as claimed in claim 1 wherein the spring biasing elements in a pre-loaded condition are produced by extension thereof.

7. A device as claimed in claim 1, wherein the device further includes a damping element arranged to provide a damped resistive force in opposition to relative movement between the members in said first direction.

8. A device as claimed in claim 7 wherein the damping element is operatively connected between the two members via a gearing mechanism.

9. A device as claimed in claim 7 wherein the damping element is in the form of a linear damper which provides its damped resistive force on compression.

10. A device as claimed in claim 1 wherein the device is arranged to provide a spring biasing force over only part of the range of relative movement between the two members.

* * * * *